US006729381B2

(12) United States Patent
Colombo

(10) Patent No.: US 6,729,381 B2
(45) Date of Patent: May 4, 2004

(54) PROCESS FOR THE PRODUCTION OF INDUSTRIAL TUBES OR SECTION BARS FROM METAL AND RELATED APPARATUS

(75) Inventor: Carlo Colombo, Vercelli (IT)

(73) Assignee: Societa' Italiana Tubi Acciaio Inossidabile (S.I.T.A.I.) S.p.A., Novara (IT)

( * ) Notice: Subject to any disclaimer, the term of this patent is extended or adjusted under 35 U.S.C. 154(b) by 20 days.

(21) Appl. No.: 10/220,666

(22) PCT Filed: Feb. 13, 2001

(86) PCT No.: PCT/EP01/01569

§ 371 (c)(1),
(2), (4) Date: Aug. 30, 2002

(87) PCT Pub. No.: WO01/64372

PCT Pub. Date: Sep. 7, 2001

(65) Prior Publication Data

US 2003/0029598 A1 Feb. 13, 2003

(30) Foreign Application Priority Data

Mar. 3, 2000 (IT) ..... MI2000A0427

(51) Int. Cl.[7] ..... B22D 11/10
(52) U.S. Cl. ..... 164/421; 164/340; 164/341
(58) Field of Search ..... 164/465, 421, 164/340, 341, 137

(56) References Cited

U.S. PATENT DOCUMENTS

| | | | | |
|---|---|---|---|---|
| 3,578,063 A | | 5/1971 | Langer | 164/421 |
| 3,578,065 A | * | 5/1971 | Langer | 164/421 |
| 3,673,836 A | | 7/1972 | Petersen et al. | 123/41.15 |
| 4,000,773 A | * | 1/1977 | Sevastakis | 164/421 |
| 4,308,908 A | * | 1/1982 | Sevastakis | 164/464 |
| 4,809,423 A | | 3/1989 | Petersen | 29/527.7 |
| 4,876,870 A | | 10/1989 | Rantanen | 72/78 |
| 5,279,353 A | * | 1/1994 | Nielsen et al. | 164/489 |

FOREIGN PATENT DOCUMENTS

| | | |
|---|---|---|
| FR | 1395479 | 3/1965 |
| FR | 1467373 | 12/1966 |

OTHER PUBLICATIONS

International Search Report for PCT/EP01/01569 dated Jul. 20, 2001.
International Written Opinion for PCT/EP01/01569 dated Mar. 4, 2002.
International Preliminary Examination Report for PCT/EP01/01569 dated Jun. 4, 2002.

* cited by examiner

*Primary Examiner*—M. Alexandra Elve
*Assistant Examiner*—I.-H. Lin
(74) *Attorney, Agent, or Firm*—Abelman, Frayne & Schwab

(57) ABSTRACT

A process for the production of industrial tubes or section bars from metal, such as copper, copper alloys, special brasses, cupronickel or aluminum bronzes, includes the following steps: melting the metal material with possible compatible working scraps; obtaining a preform from a casting; roll milling and/or drawing the preform to reduce its section; drawing with one or more concatenated intervention the roll-milled and/or drawn preform, in order to further reduce its section to the size desired; straightening and possibly submitting to thermal and/or decreasing treatment the dimensionally finished product; and cutting the finished product to measure.

6 Claims, 2 Drawing Sheets

PROCESS FOR THE PRODUCTION OF INDUSTRIAL TUBES OR SECTION BARS FROM METAL AND RELATED APPARATUS

This application is a 371 of PCT/EP01/01569 filed on Feb. 13, 2001.

BACKGROUND OF THE INVENTION

1. Field of the Invention

The present invention relates to a process for the production of industrial tubes or section bars from metal, and relates to an apparatus employed for such production. More particularly, the present invention relates to a process of continuous casting to obtain metal tubes and section bars for industrial use, especially intended for heat exchange, i.e., usable for heat exchangers or desalting plants and in the field of chemical and petrochemical plants.

2. Description of the Related Art

The materials suitable for the production of such metal tubes and section bars include copper and alloys thereof, cupronickel, special brasses, aluminum bronze, and the like.

As is known, these materials have several characteristics that render them suitable for the purpose, such as, for instance, a high electrical and thermal conductivity, a good corrosion resistance, and an excellent hot and cold workability.

In the production of these tubes and section bars, reference is made to specific directives and norms that define the chemical composition and the tolerances of the material; such norms are, for instance, the American Society for Testing and Materials (ASTM) B111 norm; the Deutsches Institut für Normung e.V. (DIN) 1785 norm, with DIN being the German Institute for Standardization which is similar to the American National Standards Institute (ANSI); the Ente Nationale Italiano di Unificazione (UNI) 6785 norm, with UNI being an Italian standards body; and the Association Francaise de Normalisation (AFNOR or NFA) 51.102 norm, with AFNOR and/or NFA being a French standards body.

Such metal tubes and section bars for industrial use are conventionally obtained by means of a process that comprises many operating steps, and that, besides causing the process to be a log, laborious, and not easily realizable one, markedly affects the cost of the finished product.

The known processes, in fact, comprise, starting from the classification of raw materials and scraps, a first step of melting the material in induction electric ovens, with preparatory treatments such as titration and alligation. Afterwards, from the casting molten material, billets are obtained, i.e. half-finished cylindrical products having a diameter generally comprised between 80 mm. and 350 mm. Billets are submitted to cutting and lumping operations, to be then transferred, in right size, on drawing presses, on prior heating to a temperature comprised between 700° C. and 1,100° C. By means of such presses, preforms are obtained having a tubular shape or other shapes, which are submitted to dimension and quality controls in general, and conveyed afterwards to a rolling mill and/or die to cold-reduce their cross-section.

This working step causes approximately an 80% reduction in the body sections, whose diameter and thickness elongate and reduce. Sometimes, in the presence of particular allows to be worked, intermediate thermal treatments are required, to make the cold working of the preforms easier. Subsequent drawing operations produce the almost finished product, whose cross-section is further reduced. The actual finishing comprises the cutting of the pieces, a possible straightening thereof, as well as controls and examinations, on prior degreasing or cleaning.

This obviously long and laborious process requires the use of many specific materials and generates a high percentage of wastes and scraps in the various steps, both during the melting which causes the realization of the billets, and during hot drawing, and also afterwards. In the general economy of the production cycle, the generation of scraps causes, in the whole, a total yield ratio equal to about 2:1.

Besides, also the costs of the plants, referring to the cast ovens and the drawing presses, are far from being negligible, as they contribute to increasing the production cost of the product.

BRIEF SUMMARY OF THE INVENTION

An object of the present invention is to obviate the above drawbacks.

More particularly, an object of the present invention is to provide a process for the realization of metal tubes or section bars for industrial use to be employed as heat exchangers, desalting plants, or chemical and petrochemical plants, that comprises a limited number of operating steps and assures a finished product provided with all the requirements needed with respect to precision, reliability, and metallographic structure.

A further object of the invention is to provide a process as defined above such as to involve, for its implementation, only limited requirements from the production plants.

A further object of the invention is to provide users with a process for the realization of metal tubes and section bars able to substantially reduce not only the length of the production plant, but also the amount of scraps generated.

According to the present invention, these and still other objects, which will become apparent from the following description, are achieved by a process for the production of tubes or section bars from metal, that comprises the following operating steps:

melting metal with possibly compatible working scraps;

obtaining a preform from the molten metal;

roll milling and/or drawing the preform to reduce the cross-section thereof;

drawing, by means of one or more concatenated interventions, the same preform up to the size desired;

strengthening and possibly submitting to thermal and/or degreasing treatments the dimensionally finished product; and cutting to measure the finished product.

The preform may have any shape, but the tubular shape is preferred.

The apparatus for the realization of the process, which is also an object of the invention, comprises a crucible and an ingot mold provided with axial and radial holes, communicating with each other, to feed the molten metal coming from the crucible. Preferably, the latter has, in the inside, a central chamber pressurized preferably with inert gases, in order to keep constant the pressure of the zone feeding the ingot mold.

BRIEF DESCRIPTION OF THE SEVERAL VIEWS OF THE DRAWINGS

The operating steps of the process of the present invention as well as the constructive and functional characteristics of the related apparatus will be better understood from the following description, wherein reference is made to the attached drawings that show a preferred non-limiting embodiment of the apparatus, and wherein.

DETAILED DESCRIPTION OF THE INVENTION

Figure 1:
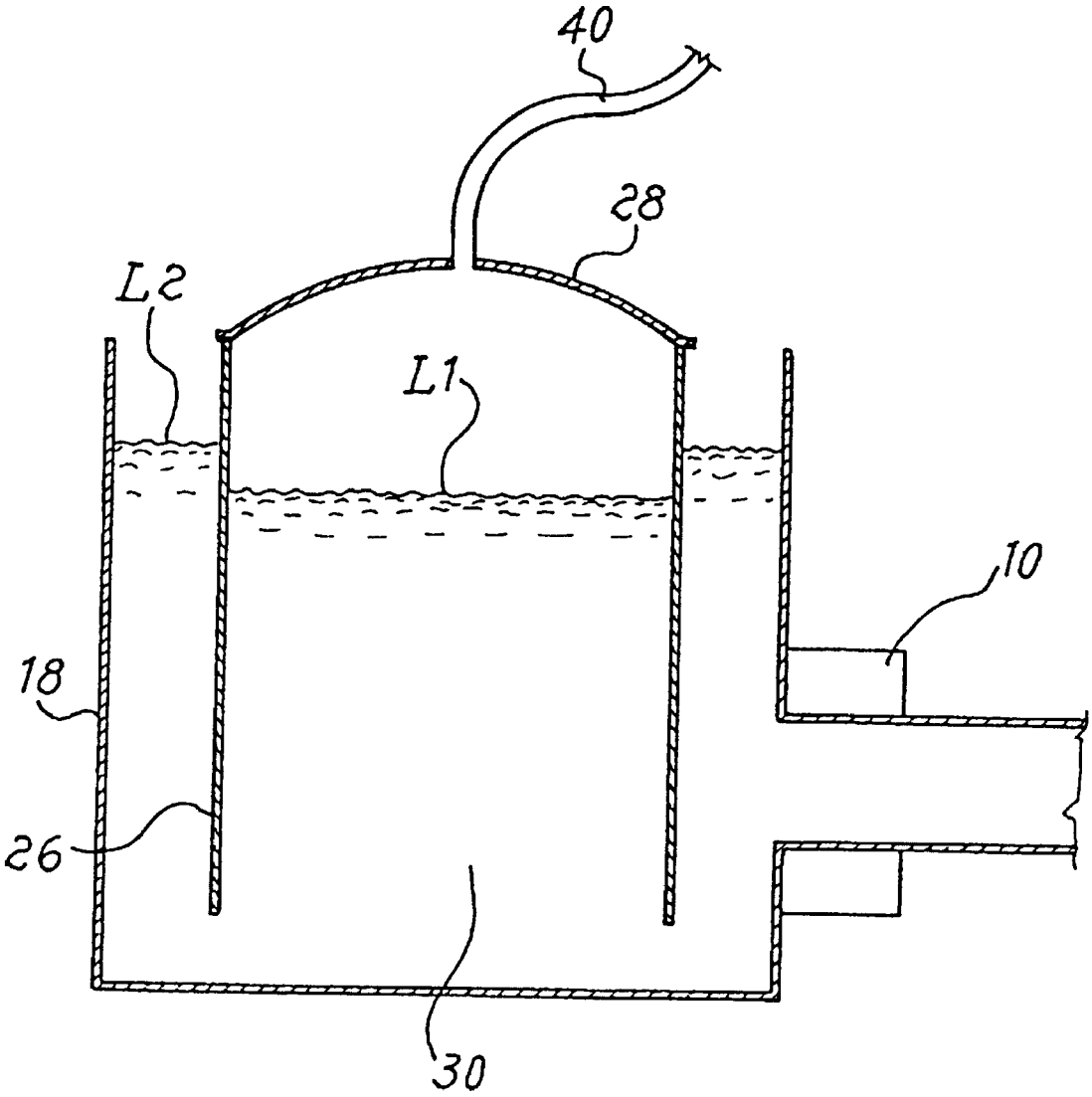
FIG. 1 shows a partial schematic view of the plant and the apparatus for the realization of metal tubes and section bars for industrial use according to the process of the present invention.

According to the invention, the process for the realization of tubes or section bars from metal comprises several working steps, described in detail in the following according to a preferred non-critical sequence.

The first one of the steps includes loading the metal material, for instance, metal or alloys thereof and the possible scraps compatible with the alloy, in the solid state, in an electric oven to realize their melting.

The melting temperature depends on the type of raw materials and scraps employed. Generally, the melting temperature is comprised between about 900° C. and about 1,350° C. If a material like cupronickel 90/10 should be used, the melting temperature ranges from about 1,250° C. and about 1,350° C.

The so obtained liquid state alloy is transferred by known means, for instance through channels, into a continuous casting system associated with the apparatus, as will be described in the following.

The apparatus essentially comprises a specific ingot mold by means of which a hollow preform is obtained. The hollow preform may have any shape and size; preferably, the preform has a tubular shape having, by way of example, a diameter comprised between about 70 mm. and about 80 mm. and a thickness comprised between about 5 mm. and about 10 mm.

The hollow preform is then conveyed to the further cold working steps on rolling mills and draw-benches, to progressively reduce the cross-section of the same. During the drawing, there is obtained a reduction in the cross-section of the preform of about 80%, while with the further drawing operation or operations, concatenated with each other, the cross-section further reduces until a dimensionally finished product is obtained.

The drawing operation is preferably carried out with cold draw-benches of the type known as pilgrim mill, or of the planetary type or the like.

The rolling mill operation or operations are preferably carried out on draw-benches rectilinear or of the combined type or the bull-block type. All these types of rolling mills and draw-benches are well known per se.

Between the rolling mill process and the drawing process steps, intermediate thermal treatment may be carried out, such as for instance annealing, especially in the presence of special alloys, such as for instance special brasses and cupronickels; also during the drawing steps there may be carried out intermediate annealing processes of the preform.

The intermediate thermal treatments are carried out in annealing walking-beam or static ovens of a known type at a temperature that may range, for instance, between about 400° C. and about 800° C. Such temperature of thermal treatment is comprised between about 650° C. and about 750° C. in the case of 90/10 cupronickel material.

The preform which, in this step, has its final shape of metal tube or section bar, is then submitted to the conventional finishing operations, i.e. cutting to measure on prior straightening, possibly degreasing and controls either individually or by sample taking.

The preform obtained with the process of the present invention has a visual aspect and a metallographic structure which are characteristic of such processes and different from a conventional hot-drawing. The preform, in fact, has the typical appearance of a material obtained from continuous casting, showing, for instance, ring shadings transverse with respect to the axis, equidistant and parallel to each other, both across the external surface and the internal one. As concerns the difference in the metallographic structure, the preform has a typically dentitric structure, therefore different from the one of the drawn product.

The process described reduces substantially the complexity and the length of the production cycle, as the starting base is constituted of a preform obtained through a continuous casting process. In fact, the process of the present invention excludes several working steps, being unnecessary to obtain a billet wherefrom the preform is obtained with draw-presses. There is therefore reduced by 50% the formation of scraps, passing to a 1.5:1 total yield ratio both during the melting which gives rise to the billet, and during the hot-drawing of the same. The high production costs, such as, for instance, those due to the energy, labor, and consumption in general, are reduced by an amount ranging from about 20% to about 40%, according to the size of the finished product.

According to a preferred embodiment, the step of extraction of the product from the apparatus or ingot mold is realized with a two-directional movement, starting from the conventional operation known as "go and stop". According to the latter, the metal tube or section bar is extracted by alternating traction steps with short dwells, to prevent breakaways in the product. To further prevent the occurrence of breakaways, which produce non-homogeneous tubes or section bars, a further "go and stop" extraction step is preferably interpolated in the process of the present invention. Such movement causes the product extracted from the ingot mold, although still not entirely consolidated, to make a minimum backward movement, to compact the product and to exclude therefore the risk of breakaways.

The overall extraction movement includes therefore a traditional traction step, a dwell step, and a further backward movement step, namely directed towards the direction contrary to the direction of movement of the preform during the extraction traction step. Such steps may possibly take place according to a different sequence, i.e. for instance a backwards movement immediately after the traction step, before the dwell step, or according to a combination of both systems.

In this way, the still-not-solidified tube or artifact is caused to become compacted and homogeneous.

According to a further preferred non-critical embodiment, the product extracted from the ingot mold is submitted to a calibration process which ensures the compactness of the metallographic structure. Such calibration includes an in-line hot milling, carried out through a conventional flashing inductor and with the intervention of a motor-driven ram. This step is preferably followed by a rapid cooling, preferably with water.

Figure 2:
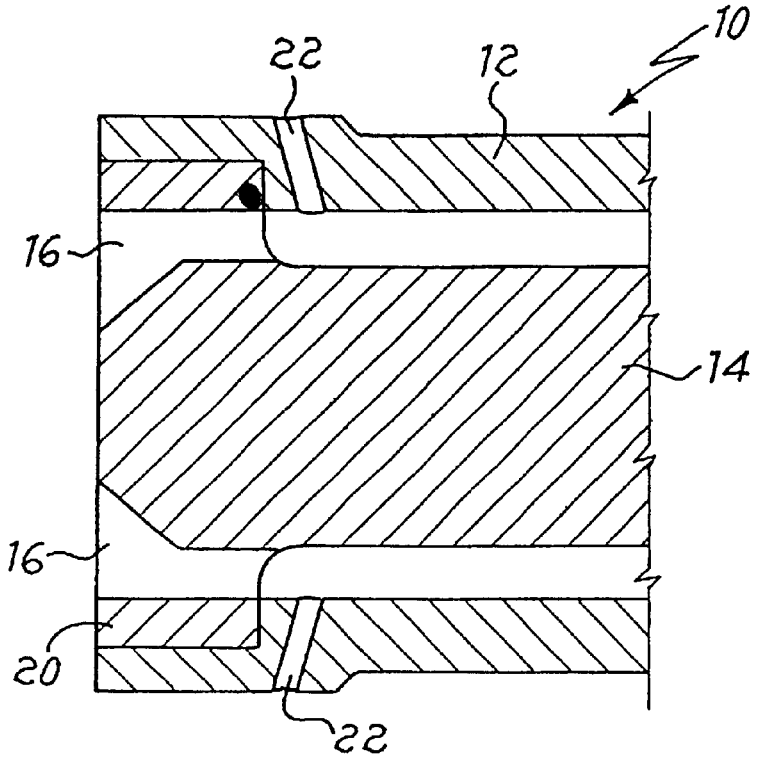
FIG. 2 shows a schematic view of a partial longitudinal section of the same apparatus constituted of an ingot mold.
Figure 3:
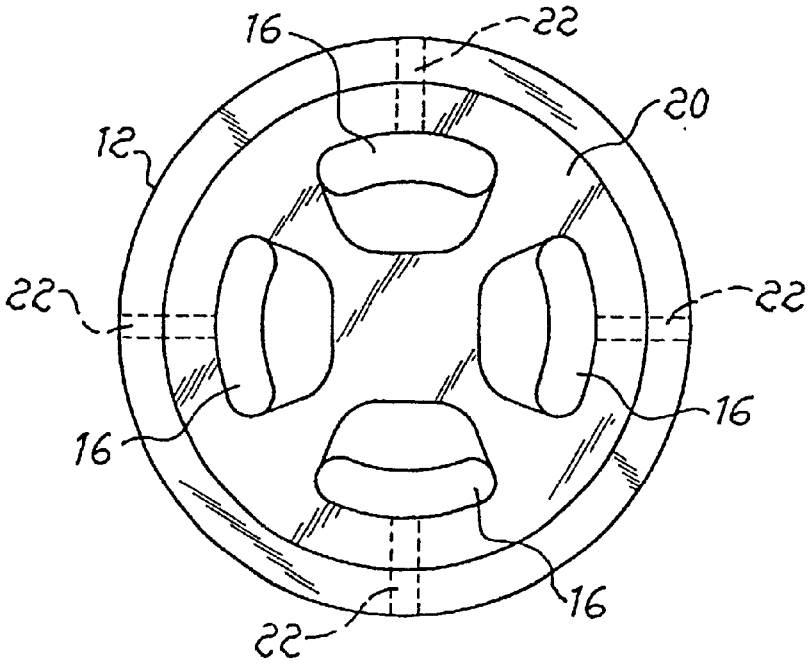
FIG. 3 shows a schematic view of a cross-section of the apparatus of FIG. 2.

The disclosed apparatus, which is also part of the present invention, is especially suitable for carrying out the process of the present invention, and includes an ingot mold 10 shown in FIGS. 2–3, formed by an external body or envelope 12 and a coaxial pin 14 composed of graphite or other suitable materials. The ingot mold 10 is provided with conventional axial holes 16 for the feeding of the molten metal, fed by a crucible 18 schematized and shown in FIG. 1, obtained from refractory material, graphite, or masonry.

The holes 16 are formed on a support or bridge 20 which supports the pin 14. In addition to the holes 16, the ingot mold 10 is advantageously provided with further radial feeding holes 22, for instance, four holes arranged in radial angles at every 90° which are formed on the external body 12 downstream of the bridge 20. The holes 22, by way of example, are inclined relative to a predetermined plane, such as a plane perpendicular to the longitudinal axis of the ingot mold 10, and communicate with the holes 16, allowing the feeding of the ingot mold 10 with an additional amount of molten metal which mixes suitably and remains at the stable temperature required to form the preform.

The homogenization of the metal, due to the additional feeding through the holes 22, is of basic importance in those cases, as is the present one, of alloys whose components have different melting points and physical-chemical characteristics.

According to a further and advantageous characteristic, the apparatus of the present invention keeps constant the weight generated by the metallostatic load in the feeding zone of the ingot mold 10, also during the variations in the liquid which take place in the crucible 18. For this purpose, as shown in FIG. 1, the crucible 18 is provided with a bell-shaped region 26 inserted centrally in the crucible 18 and tied or otherwise attached to the crucible 18 with known means. The upper front 28 of the bell 26 is constituted of a tight lid. A tube or duct 40 is connected to the lid 28, through which there is inserted, for instance, a neutral or inert gas into the bell 26. The bell 26 forms, in the inside of the crucible 18, a central chamber 30, wherein a pressure, preferably comprised between about zero bars and about two bars, is applied to the free surface of the molten metal.

As shown in FIG. 1, the level of molten metal existing in the inside and the outside of the central chamber 30 are indicated respectively by L1 and L2. By means of such pressure with inert gas, the liquid state metal is fed in a constant and homogeneous manner to the ingot mold 10 through holes 16, 22 of the same, as shown in FIGS. 2–3, and is not affected by the level variations.

The apparatus of the present invention also comprises cold rolling mills and draw-benches to reduce progressively the section of the preform up to the size desired. During the drawing step or between a rolling mill step and a drawing step, the preform may be submitted to thermal treatments, such as for instance annealing. The so obtained section bar may be submitted to straightening, degreasing treatments, and the like, and then cut to measure.

As can be understood from the above description, the advantages achieved by the invention are evident.

With the process for the realization of metal tubes or section bars of the present invention, the length and complexity of the production cycle are reduced substantially, being possible to obtain the preform from melting instead of drawing. In the same way, the working scraps and plant requirements reduce to a substantial extent, with no casting being needed to obtain the billets and the draw-press.

While the present invention has been described above with reference to an embodiment of the same, solely reported by way of non-limiting examples, various modifications and changes will be evident to those skilled in the art, in the light of the above description. Therefore, the present invention encompasses all the modifications and variants that fall within the spirit and scope of the following claims.

What is claimed is:

1. An apparatus for continuous casting of a molten copper alloy to obtain a hollow tubular preform for the production of a metallic product, in the form of a tube or section bar, for industrial use from a copper alloy, the apparatus comprising:

a crucible; and an ingot mold connected to the crucible and including:

an external body;

a pin coaxial and internal to the external body;

a bridge supporting the pin;

a plurality of axial feeding holes formed on the bridge and feeding the molten alloy from the crucible; and at least one radial feeding hole communicating with a first axial feeding hole of the plurality of axial feeding holes, and feeding an additional amount of the molten alloy from the crucible to the first axial feeding hole wherein the at least one radial feeding hole is positioned on the external body of the ingot mold downstream of the bridge.

2. The apparatus according to claim 1, wherein the internal pin and the crucible are composed from material selected from the group consisting of:

refractory material;

graphite; and masonry.

3. The apparatus according to claim 1, wherein the at least one radial feeding hole includes:

four radial feeding holes arranged radially about the ingot mold at angular distances from each other of about 90°.

4. The apparatus according to claim 1, wherein the at least one radial feeding hole is inclined relative to a predetermined plane.

5. The apparatus according to claim 1, wherein the crucible includes, in a central portion thereof:

a bell-shaped region forming a chamber, with an upper front of the bell having a tight-lid, and with the upper front of the bell being connected to a duct for feeding inert gas to the chamber.

6. The apparatus according to claim 5, wherein the pressure of the inert gas in the chamber, on a free surface of the molten metal, is in the pressure range between about zero bars and about two bars.

* * * * *